US007520707B1

(12) United States Patent
Ness

(10) Patent No.: US 7,520,707 B1
(45) Date of Patent: Apr. 21, 2009

(54) BULK BAG TRANSPORT APPARATUS

(76) Inventor: Daniel W. Ness, P.O. Box 9098, Metairie, LA (US) 70055

( * ) Notice: Subject to any disclaimer, the term of this patent is extended or adjusted under 35 U.S.C. 154(b) by 238 days.

(21) Appl. No.: 11/531,926

(22) Filed: Sep. 14, 2006

Related U.S. Application Data

(60) Provisional application No. 60/735,448, filed on Nov. 10, 2005.

(51) Int. Cl.
*B65D 88/12* (2006.01)

(52) U.S. Cl. ..... 410/31

(58) Field of Classification Search ..... 410/31, 410/32, 42, 46; 220/1.5, 1.6, 4.01, 4.26, 220/4.27, 23.83, 694
See application file for complete search history.

(56) References Cited

U.S. PATENT DOCUMENTS 3,819,044 A * 6/1974 Bockenstette ..... 206/507
4,027,796 A * 6/1977 Martin ..... 206/507
5,335,789 A * 8/1994 Taravella et al. ..... 206/518
5,555,845 A * 9/1996 Flynn ..... 119/201
6,041,931 A * 3/2000 Jacques ..... 206/505
2007/0108085 A1 * 5/2007 Andrade ..... 206/515

* cited by examiner

*Primary Examiner*—H Gutman
(74) *Attorney, Agent, or Firm*—Garvey, Smith, Nehrbass & North, L.L.C.; Charles C. Garvey, Jr.

(57) ABSTRACT

A bulk bag transport apparatus employs a receptacle that is divided into a plurality of bulk bag holding sectors. The receptacle provides a base that is constructed of a plurality of beams such as eye beams including peripheral beams and transverse beams. Each side wall is reinforced with a plurality of inclined beams that preferably join to the transverse bottom beams, one inclined beam attaching to a transverse bottom beam. A plurality of other beams are attached to the upper edge of the receptacle and each inclined beam is structurally joined to a peripheral beam. Lifting eyes are provided along each side of the receptacle, each lifting eye performs an acute angle with an inclined beam and is preferably mounted to an inclined beam. A lifting harness includes slings that can be connected to the lifting eyes. Each side wall has an horizontal flange or a member that enables one of the receptacles to be stacked upon the other of the receptacles wherein the upper peripheral beam of one receptacle engages and supports the horizontal flange or member of another receptacle.

26 Claims, 4 Drawing Sheets

BULK BAG TRANSPORT APPARATUS

CROSS-REFERENCE TO RELATED APPLICATIONS

Priority of U.S. Provisional Patent Application Ser. No. 60/735,448, filed Nov. 10, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the transport of bulk bags with a specially configured receptacle that carries a plurality of bulk bags side by side. Even more particularly, the present invention relates to a new and improved bulk bag transport apparatus that features a receptacle having a plurality of inclined side walls, a bottom wall and an interior with an open top. The receptacles are configured to be stacked, one inside of the other with load transfer between the stacked receptacles employing the longitudinally extending generally horizontally configured flange attached to the side wall of each receptacle and being structurally connected to a plurality of inclined beams that reinforce the side wall, each of the inclined beams extending between base beams and peripheral upper beams.

2. General Background of the Invention

In the drilling and production of oil and gas, many chemicals necessarily must be transported to a drill site which can in many instances be many miles offshore in a marine environment.

The transfer of materials to these remote marine locations can be costly and dangerous. Thus, there is a need for a simple yet effective way to transport materials to oil and gas well drilling and production platforms in an offshore marine environment.

Once a delivery is made to an offshore location, floor space is at a premium. Offshore oil and gas well drilling facilities are quite expensive to construct and there is very little extra space for the storage of supplies. It is to this problem that the present invention is directed.

The present invention provides a bulk bag transport apparatus that includes a receptacle having a plurality of side walls, a bottom wall, an interior and an open top surrounded by an upper edge.

A base supporting the bottom wall is provided. The base includes peripheral beams and transverse bottom beams that segment the interior into a plurality of bulk bag holding sectors.

Each side wall is reinforced with a plurality of inclined beams, each inclined beam joining to a transverse bottom beam.

A plurality of upper peripheral beams attach to the upper edge of the receptacle join to an inclined beam that extends downwardly to meet with the transverse beams of the base.

A plurality of lifting eyes are provided, each mounted to an inclined beam and each forming an acute angle therewith.

A lifting harness includes slings that connect to the lifting eyes.

Each side wall has a horizontal flange or member that enables one of the set receptacles to be stacked upon another of said receptacles, wherein the upper peripheral beam of one receptacle engages and supports the horizontal flange or member of another receptacle.

BRIEF SUMMARY OF THE INVENTION

A bulk bag transport apparatus employs a receptacle that is divided into a plurality of bulk bag holding sectors. The receptacle provides a base that is constructed of a plurality of beams such as eye beams including peripheral beams and transverse beams. Each side wall is reinforced with a plurality of inclined beams that preferably join to the transverse bottom beams, one inclined beam attaching to a transverse bottom beam. A plurality of other beams are attached to the upper edge of the receptacle and each inclined beam is structurally joined to a peripheral beam. Lifting eyes are provided along each side of the receptacle, each lifting eye performs an acute angle with an inclined beam and is preferably mounted to an inclined beam. A lifting harness includes slings that can be connected to the lifting eyes.

Each side wall has an horizontal flange or a member that enables one of the receptacles to be stacked upon the other of the receptacles wherein the upper peripheral beam of one receptacle engages and supports the horizontal flange or member of another receptacle.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
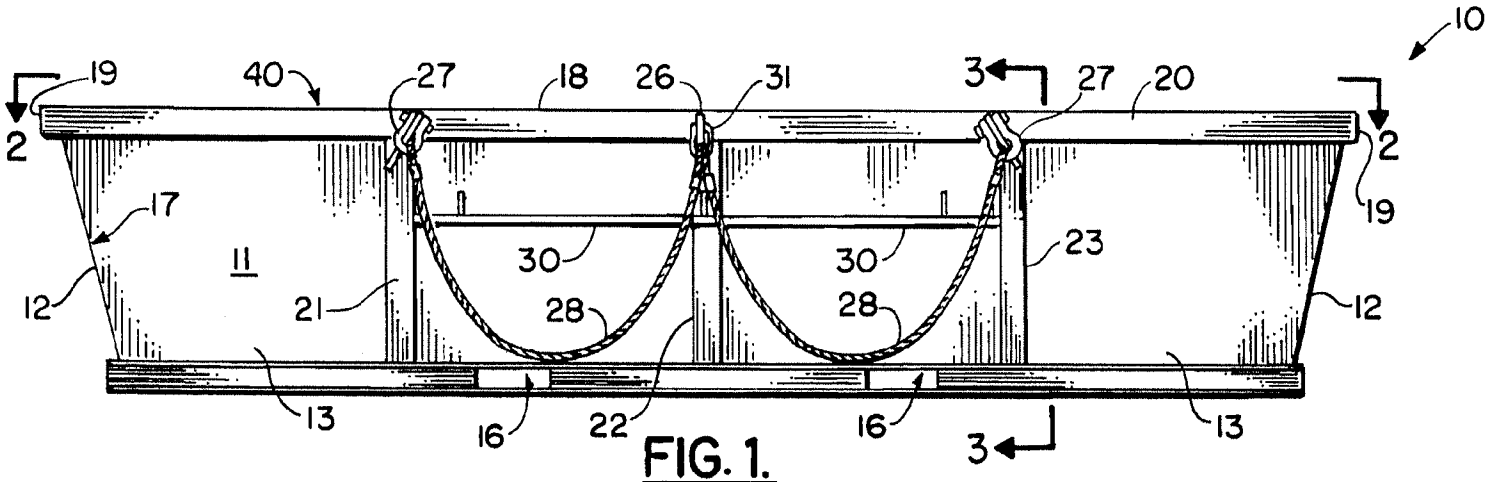
FIG. 1 is an elevation view of the preferred embodiment of the apparatus of the present invention.
Figure 2:
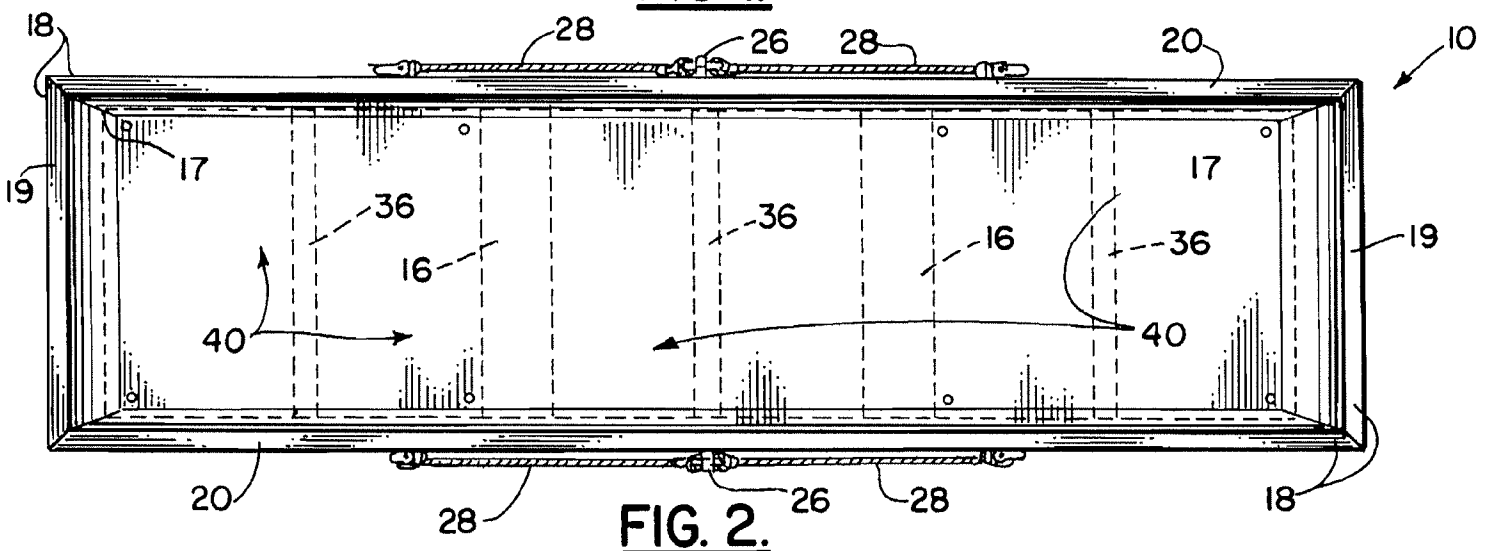
FIG. 2 is a top, plan view of the preferred embodiment of the apparatus of the present invention taken along lines 2-2 of FIG. 1.
Figure 3:
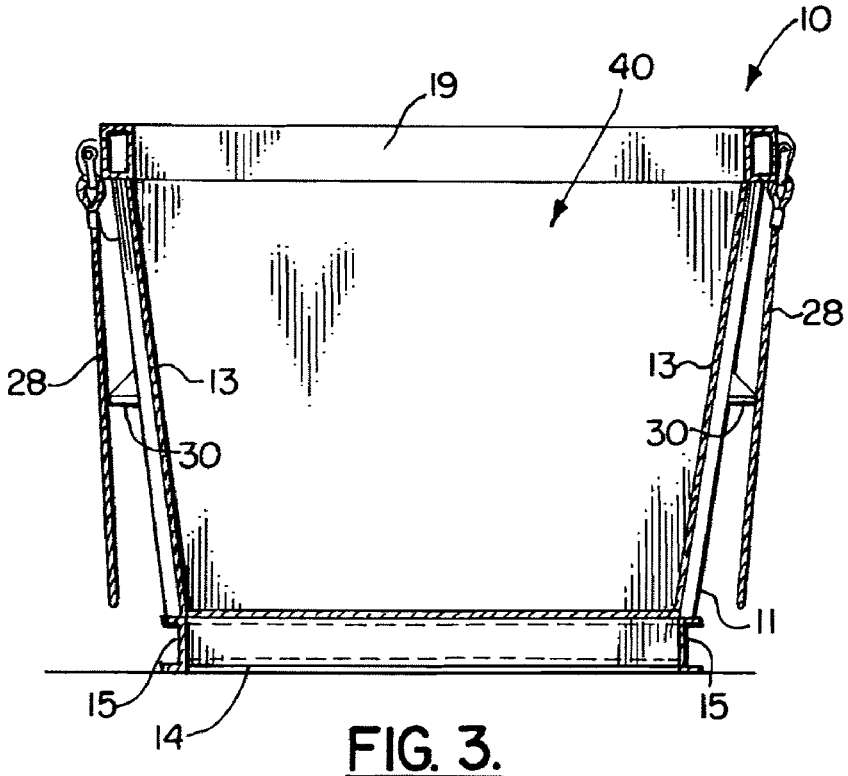
FIG. 3 is a sectional view of the preferred embodiment of the apparatus of the present invention taken along lines 3-3 of FIG. 1.
Figure 4:
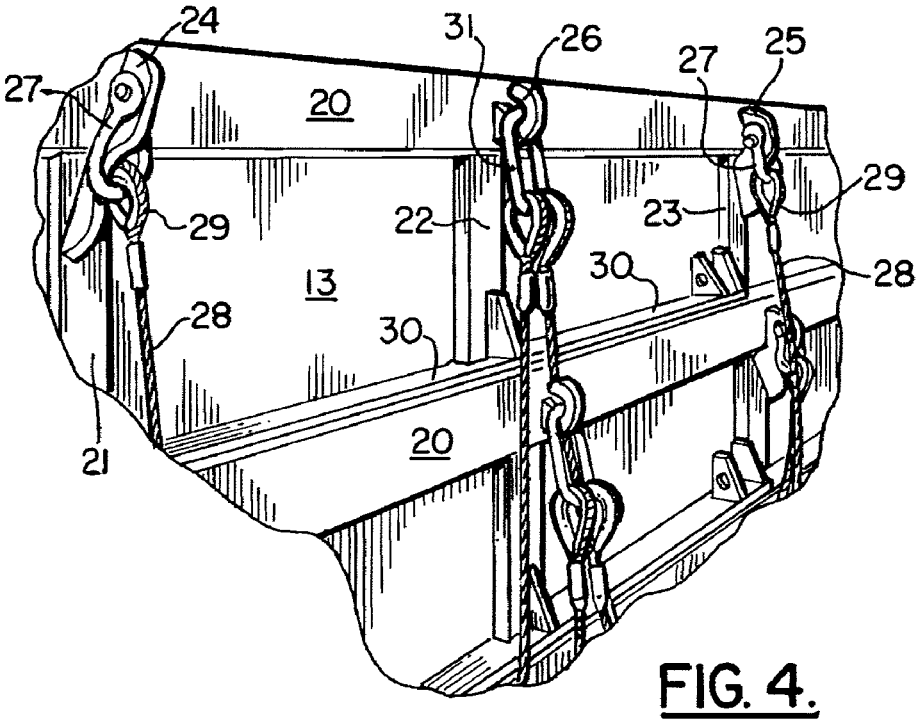
FIG. 4 is a fragmentary perspective view of the preferred embodiment of the apparatus of the present invention.

FIGS. 1-6 show the preferred embodiment of the apparatus of the present invention designated generally by the numeral 10. Bulk bag transport apparatus 10 provides a uniquely configured receptacle 11. Receptacle 11 has end walls 12 and side walls 13. In the preferred embodiment, either or both of the end walls 12 and side walls 13 can be inclined as shown, wherein a wall 12 meets a wall 13 at inclined edge 17.

A base 14 is provided that includes a plurality of lower peripheral beams 15 such a channel beams or I-beams. Transverse beams 36 (e.g. channel or I beam) are provided that extend perpendicularly to the pair of lower peripheral beams 15 that are next to the side walls 13 (see FIGS. 2 and 3). Each lower peripheral beam 15 also attaches to an inclined beam 21, 22, 23. Each inclined beam 21, 22, 23 extends upwardly and forms a connection with an upper peripheral beam 18, namely a side upper peripheral beam 20. The upper peripheral beams also include upper peripheral end beams 19. Sockets or slots 16 can be provided, enabling a fork lift to connect to and lift apparatus 10.

Thus, each inclined beam 21, 22, 23 is structurally connected to the base 14 at a lower peripheral beam 15 as well as being structurally connected to an upper peripheral beam 18, namely a upper peripheral side beam 20.

A plurality of lifting eyes 24, 25 are provided. Each lifting eye 24, 25 is attached (e.g. welded) to both an inclined beam 21, 22, 23 and a side upper peripheral beam 20 (see FIGS. 1 and 4). A rigging hanger 26 is positioned in between the lifting eyes 24, 25.

Each lifting eye 24, 25 provides a point for attachment of a lifting sling 28 using a shackle 27 as shown. Each sling 28 has eyelets 29 at its end portions for enabling a connection to the selected lifting eye 24 or 25 using a shackle 27.

Horizontal member or flange 30 extends horizontally from beam 21 to beam 22 and also from beam 22 to beam 23 and at a position in between lower peripheral beams 15 and side upper peripheral beams 20, positioned about midway therebetween as shown. Horizontal flange 30 also forms a structural connection (e.g. welded) to a side wall 13 and to multiple of the inclined beams 21, 22, 23 as shown.

Each of the slings 28 on a given side of the receptacle 11 attaches to a lifting ring 31. This ring 31 can be stored by placing it upon rigging hanger 26 (see FIG. 4).

Figure 5:
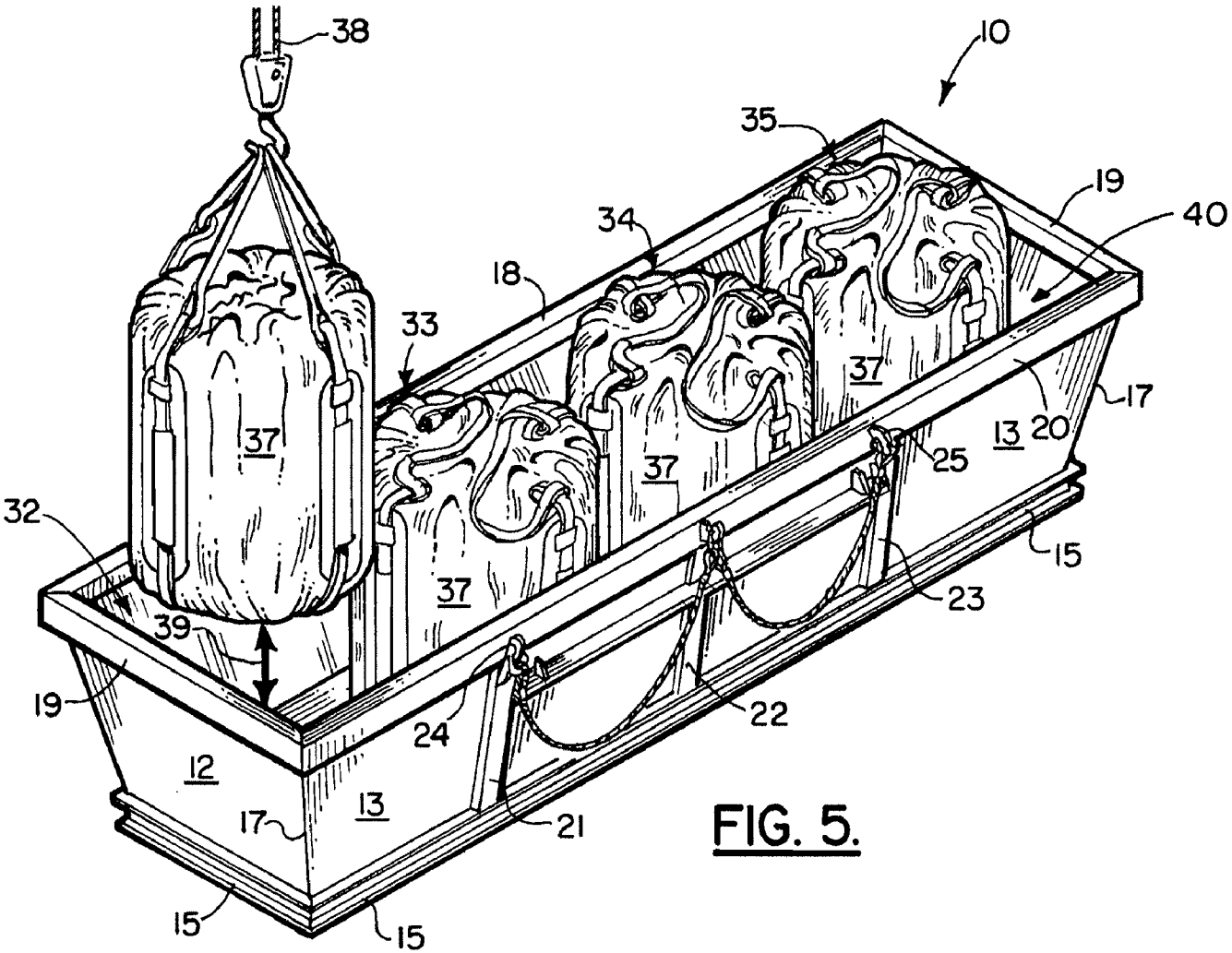
FIG. 5 is a perspective view of the of the preferred embodiment of the apparatus of the present invention.

In the embodiment shown in FIGS. 1-5, there are four bulk bag sectors 32, 33, 34, 35 (see FIG. 5). The sector 32 is positioned in between inclined beam 21 and an end wall 12. The sector 33 is positioned in between inclined beam 21 and inclined beam 22. In like manner, the bulk bag sector 34 is positioned in between inclined beam 22 and inclined beam 23. The last bulk bag sector 35 is positioned in between inclined beam 23 and an end wall 12 that is closest to the inclined beam 23.

Figure 6:
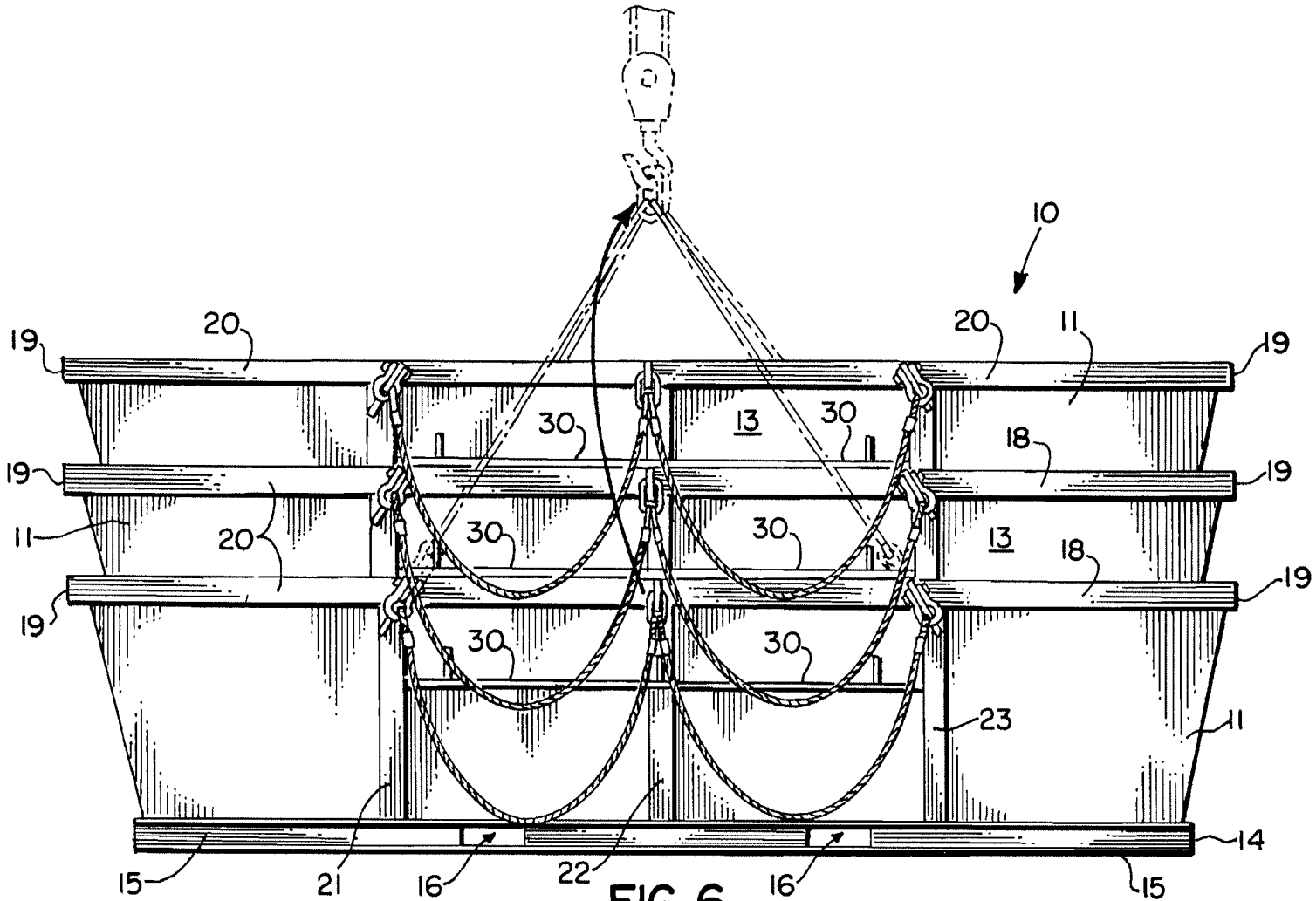
FIG. 6 is a side, elevation view of the preferred embodiment of the apparatus of the present invention illustrating stacking.

FIG. 5 shows that a bulk bag 37 can be lifted with a crane lift line 38 for placing bag 37 into or removing bag 37 from the interior 40 of receptacle 11 (see arrow 39, FIG. 5). In FIG. 6, three receptacles 11 are shown in a stacked, storage position wherein horizontal flanges 30 of one receptacle rest upon the side upper peripheral beams 20 of another receptacle below it. Receptacle 11 can be of a welded steel or welded aluminum construction.

The following is a list of parts and materials suitable for use in the present invention:

PARTS LIST:

| Parts Number | Description |
|---|---|
| 10 | bulk bag transport apparatus |
| 11 | receptacle |
| 12 | end wall |
| 13 | side wall |
| 14 | base |
| 15 | lower peripheral beam |
| 16 | transverse slot |
| 17 | inclined edge |
| 18 | upper peripheral beam |
| 19 | end peripheral beam |
| 20 | side peripheral beam |
| 21 | inclined beam |

-continued

PARTS LIST:

| Parts Number | Description |
|---|---|
| 22 | inclined beam |
| 23 | inclined beam |
| 24 | lifting eye |
| 25 | lifting eye |
| 26 | rigging hanger |
| 27 | shackle |
| 28 | sling |
| 29 | eyelet |
| 30 | horizontal flange |
| 31 | ring |
| 32 | bulk bag sector |
| 33 | bulk bag sector |
| 34 | bulk bag sector |
| 35 | bulk bag sector |
| 36 | transverse beam |
| 37 | bulk bag |
| 38 | lift line |
| 39 | arrow |
| 40 | interior |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A bulk bag transport apparatus comprising:

a) a receptacle having a plurality of side walls, a bottom wall, an interior, and an open top surrounded by an upper edge;

b) a base supporting the bottom wall, said base including lower peripheral beams and transverse bottom beams that segment the interior into a plurality of bulk bag holding sectors;

c) each side wall being reinforced with a plurality of inclined beams that each join to one said transverse bottom beam;

d) a plurality of upper peripheral beams attached to the upper edge of the receptacle, each inclined beam being structurally joined to a peripheral beam;

e) a plurality of lifting eyes, each mounted to one said inclined beam and forming an acute angle therewith;

f) a lifting harness that includes slings that connect to the lifting eyes; and g) each sidewall having a horizontal flange that enables said receptacle to be stacked upon another identical receptacle, wherein the upper peripheral beam of the receptacle engages and supports the horizontal flange of the other identical receptacle.

2. The bulk bag transport apparatus of claim 1 wherein a pair of the slings are attached to a pair of lifting eyes at one said side wall of the receptacle, another pair of the slings being attached to another pair of lifting eyes on an opposite one of said side walls of the receptacle.

3. The bulk bag transport apparatus of claim 2 wherein each pair of the slings attaches to a lifting ring.

4. The bulk bag transport apparatus of claim 3 further comprising a rigging hanger in between two of said lifting eyes for holding rigging when the receptacle is not being lifted.

5. The bulk bag transport apparatus of claim 1 wherein each horizontal flange is positioned in between a said lower and a said upper peripheral beam.

6. The bulk bag transport apparatus of claim 1 wherein each horizontal flange connects structurally to a pair of said inclined beams.

7. The bulk bag transport apparatus of claim 1 wherein there are at least three of said bulk bag holding sectors.

8. The bulk bag transport apparatus of claim 1 wherein there are at least four of said bulk bag holding sectors.

9. The bulk bag transport apparatus of claim 1 wherein one or more of the sidewalls are inclined.

10. The bulk bag transport apparatus of claim 1 wherein all of the sidewalls are inclined.

11. The bulk bag transport apparatus of claim 1 further comprising a plurality of bulk bags that occupy the interior of the receptacle.

12. The bulk bag transport apparatus of claim 11 wherein each bulk bag occupies one of said bulk bag holding sectors.

13. A bulk bag transport apparatus comprising:

a) a receptacle having a plurality of side walls, a bottom wall, an interior, and an open top surrounded by an upper edge;

b) a base supporting the bottom wall, said base including lower peripheral beams and transverse bottom beams that segment the interior into a plurality of bulk bag holding sectors;

c) each side wall being reinforced with a plurality of inclined beams that each join to a said transverse bottom beam;

d) a plurality of upper peripheral beams attached to the upper edge of the receptacle, each inclined beam being structurally joined to one said upper peripheral beam;

e) a plurality of lifting eyes mounted to the receptacle for enabling the receptacle to be lifted;

f) a lifting harness that includes slings that connect to the lifting eyes; and g) each sidewall having a horizontal flange that enables said receptacle to be stacked upon another and similarly configured receptacle, wherein the upper peripheral beam of said receptacle engages and supports the horizontal flange of said similarly configured receptacle.

14. The bulk bag transport apparatus of claim 13 wherein each lifting eye is attached to a said inclined beam.

15. The bulk bag transport apparatus of claim 13 wherein each lifting eye is attached to a said peripheral beam.

16. The bulk bag transport apparatus of claim 14 wherein each lifting eye is attached to both a said inclined beam and a said peripheral beam.

17. The bulk bag transport apparatus of claim 13 wherein a pair of the slings are attached to a pair of said lifting eyes at one said side wall of the receptacle, another pair of the slings being attached to a pair of said lifting eyes on an opposite one of said side walls of the receptacle.

18. The bulk bag transport apparatus of claim 17 wherein each pair of the slings attaches to a lifting ring.

19. The bulk bag transport apparatus of claim 18 further comprising a rigging hanger in between two of said lifting eyes for holding rigging when the receptacle is not being lifted.

20. The bulk bag transport apparatus of claim 13 wherein each horizontal flange is positioned in between a said lower and a said upper peripheral beam.

21. The bulk bag transport apparatus of claim 13 wherein each horizontal flange connects structurally to a pair of said inclined beams.

22. The bulk bag transport apparatus of claim 13 further comprising a plurality of bulk bags that occupy the interior of the receptacle.

23. The bulk bag transport apparatus of claim 22 wherein each bulk bag occupies one of said bulk bag holding sectors.

24. A bulk bag transport apparatus comprising:

a) a plurality of stackable receptacles, each receptacle having a plurality of side walls, a bottom wall, an interior, and an open top surrounded by an upper edge;

b) each receptacle having a base supporting the bottom wall, said base including lower peripheral beams and transverse bottom beams that segment the interior into a plurality of bulk bag holding sectors;

c) each said side wall being reinforced with a plurality of inclined beams that each join to a said transverse bottom beam;

d) each receptacle having a plurality of upper peripheral beams attached to the upper edge of the receptacle, each inclined beam being structurally joined to one said upper peripheral beam;

e) each receptacle having a plurality of lifting eyes mounted to the receptacle for enabling the receptacle to be lifted; and f) each sidewall having a horizontal flange that enables one of said receptacles to be stacked upon another of said receptacles, wherein the upper peripheral beam of one said receptacle engages and supports the horizontal flange of another said receptacle.

25. The bulk bag transport apparatus of claim 24 further comprising a plurality of bulk bags that occupy the interior of the receptacle.

26. The bulk bag transport apparatus of claim 25 wherein each bulk bag occupies one of said bulk bag holding sectors.

* * * * *